US006585589B2

(12) United States Patent
Okuniewicz

(10) Patent No.: US 6,585,589 B2
(45) Date of Patent: Jul. 1, 2003

(54) LOTTERY GAME/GAMING DEVICE INTERFACE

(76) Inventor: Douglas M. Okuniewicz, 330 E. Warm Springs Rd., Suite A-2, Las Vegas, NV (US) 89119

( * ) Notice: Subject to any disclaimer, the term of this patent is extended or adjusted under 35 U.S.C. 154(b) by 0 days.

(21) Appl. No.: 09/834,537

(22) Filed: Apr. 13, 2001

(65) Prior Publication Data

US 2001/0036854 A1 Nov. 1, 2001

Related U.S. Application Data

(60) Provisional application No. 60/196,827, filed on Apr. 13, 2000.

(51) Int. Cl.[7] ..... A63F 9/24; A63F 1/00

(52) U.S. Cl. ..... 463/17; 273/138.1

(58) Field of Search ..... 463/1, 10–22, 463/29–30, 37, 43–44, 47; 273/138.1, 139, 143 R; 710/8–20, 5, 18, 32–34, 73, 62–65

(56) References Cited

U.S. PATENT DOCUMENTS 5,709,603 A * 1/1998 Kaye ..... 463/17
5,772,511 A * 6/1998 Smeltzer ..... 463/17
6,113,098 A * 9/2000 Adams ..... 273/143 R
6,244,595 B1 * 6/2001 Kelly et al. ..... 273/138.1
6,251,014 B1 * 6/2001 Stockdale et al. ..... 463/16
6,322,446 B1 * 11/2001 Yacenda ..... 463/16

* cited by examiner

*Primary Examiner*—Kim Nguyen
(74) *Attorney, Agent, or Firm*—Adam H. Jacobs

(57) ABSTRACT

A lottery terminal/electronic device interface includes at least one detection device adapted for connection to an electronic device, the detection device operative to detect selected event occurrences on an electronic device and output event occurrence notification signals upon detection of an event or series of events. An interface device is connected in information transmission connection with the detection device, the interface device operative to detect and receive event occurrence notification signals from the detection device, analyze and translate the event occurrence notification signals and output lottery terminal operation commands. Finally, a lottery terminal device is connected in information transmission connection with the interface device, the lottery terminal device operative to receive the lottery terminal operation commands output by the interface device and output at least one entry ticket into a preselected lottery event whereby an operator or a player of the electronic device receives at least one entry into the preselected lottery event.

9 Claims, 2 Drawing Sheets

LOTTERY GAME/GAMING DEVICE INTERFACE

CROSS-REFERENCE TO RELATED APPLICATION

This application claims priority to the filing date of a related provisional application Ser. No. 60/196,827 filed Apr. 13, 2000.

BACKGROUND OF THE INVENTION

1. Technical Field

The present invention relates to interface devices for electronic devices and, more particularly, to a lottery game/gaming device interface which is operative to signal a lottery terminal to output a ticket for entry into the lottery when a preset event or series of events occurs in or around the gaming device.

2. Description of the Prior Art

Slot machines and video poker machines continue to be the most widely used types of video gaming devices found in the gaming industry. While the types and designs of the slot machines and video poker machines have continued to evolve, game play has remained generally the same in that when a specific combination is hit on the reels or turned up in the cards, it produces particular winning combinations and payouts based on the pay table of the slot machine or video poker machine. With that in mind, many slot machine manufacturers have attempted to increase the excitement generated by game play by adding peripheral devices such as sound generators or video screens which promote increased game play by presenting entertaining accompaniments to the game play of the slot machine or video poker machine. The trend has continued in that many of the currently produced slot machines and video gaming devices include various bonus generators which are shown on accompanying video screens or other informational devices as an entertaining way for a slot machine player to receive a bonus. Of course, due to the limitations of the slot machines, a bonus is generally paid in additional credits or coin which, while admittedly generating additional interest in the game, can only go so far to increase the enjoyment and hence encourage repeated game play of the device. There is therefore a need for a bonusing system which produces a bonus which is randomly generated and includes a bonusing factor beyond mere credits.

One of the most popular forms of gambling currently available are the random drawing lotteries offered by many states, such as Powerball, Pick 5, The Big Game and other such random lottery drawings. Obviously, due to the nature of these drawings, it is much more difficult to win the significant amounts of money than the smaller jackpots available by playing slot machines or the like, but it is the appeal of these enormous amounts of money that lure people to participate in the various lotteries. Currently, there is little, if any, connection between slot machine play and random drawing or scratch ticket lottery play, although the two forms of gambling are often participated in by the same gambler. It is entirely possible that the synergy produced by being able to simultaneously participate in these two generally disassociated forms of gambling will increase the amount of game play of both forms of gambling. It is clear that when casinos enter a market, the amount of money spent on lotteries decreases. It is believed that creating a closer connection between casino operations and lottery games will increase the exposure for the lottery games, introducing them to a new group of consumers, thereby increasing revenues. Therefore, there is a need for a gambling connection between slot machines and lotteries which will permit a gambler to participate in the two forms of gambling generally simultaneously.

Some of the most popular forms of slot machines currently available on the market are found in Quartermania, Cool Millions and Megabucks, amongst other state-wide progressive links, which offer the opportunity for the player to win upwards of one million dollars on a single spin of the slot machine. Of course, though the chances of winning the top jackpot are very small, a player will play the game for that chance and also for the enjoyment of winning smaller prizes during game play. It is believed that the game play will be further enhanced by the addition of additional chances for the winning of even more significant amounts of money, such as through a Powerball jackpot or the like. There is therefore a need for an interface between a slot machine and a lottery terminal to permit the dispensing of lottery tickets in response to particular reel combinations or particular events occurring on the slot machine board, thereby enhancing game play.

Therefore an object of the present invention is to provide a lottery game/gaming device interface.

Another object of the present invention is to provide a lottery game/gaming device interface which will permit the dispensing of an entry ticket into a lottery drawing in response to a particular event or series of events occurring on the slot machine board or in and around the slot machine.

Another object of the present invention is to provide a lottery game/gaming device interface which will enhance game play and encourage additional game play for the gaming device player.

Another object of the present invention is to provide a lottery game/gaming device interface which will receive event notification signals from the gaming device, translate those event occurrence signals into discernable commands for a lottery terminal and command the lottery terminal to output a particular type of lottery entry ticket in response to the occurrence of a particular event or series of events in the slot machine.

Finally, it is an object of the present invention to provide a lottery game/gaming device interface which is efficient in design and use and will encourage increased patronage of the electronic device and therefore of the lottery itself.

SUMMARY OF THE INVENTION

The present invention provides a lottery terminal/electronic gaming device interface including at least one detection device adapted for connection to an electronic gaming device, the detection device operative to detect selected event occurrences on an electronic apparatus and output event occurrence notification signals upon detection of an event. An interface device is connected in information transmission connection with the detection device, the interface device operative to detect and receive event occurrence notification signals from the detection device, analyze and translate the event occurrence notification signals and output lottery terminal operation commands. Finally, a lottery terminal device is connected in information transmission connection with the interface device, the lottery terminal device operative to receive the lottery terminal operation commands output by the interface device and output at least one entry ticket into a preselected lottery event whereby an operator/player of the electronic gaming device receives at least one entry into the preselected lottery event.

The advantages of the present invention over those devices found in the prior art are numerous and include the fact that the present invention may be added to any existing gaming device to produce command outputs in response to event occurrences in the electronic apparatus, thereby printing at least one lottery entry ticket. Furthermore, because the present invention may be quickly and easily reprogrammed to respond to different gaming device events, a variety of response schemes may be instituted over the life span of a gaming device, thus insuring that consumer interest in the games remain relatively high. Also, because the present invention is designed to sample events off of the gaming device without modifying the probabilities of gaming occurrences, it is believed that the present invention will be acceptable for use with slot machines and the like requiring little or no additional inspection and certification by the gaming and lottery commissions of the various jurisdictions or their agents.

The present invention also combines the excitement of the traditional slot machine or video gaming device with a heretofore entirely separate element of gaming, the lottery game. With the present invention, not only are winning reel combinations paid, but the player also will have the opportunity to win huge bonus prizes with his or her entry into the associated lottery event. Therefore, the present invention provides a substantial improvement over those devices found in the prior art.

DESCRIPTION OF THE PREFERRED EMBODIMENT

The lottery game/gaming device interface of the present invention is primarily designed to enhance both the game play of a standard gaming device in a casino or the like, the standard gaming device usually being a slot machine, video slot machine or video poker game, video lottery terminal or other electronic gaming device, and lottery sales and exposure. The enhancement of game play occurs when a particular event or series of events occurs in the gaming device which results in the dispensing of a lottery ticket, preferably of the Powerball® or Lotto® type of on-line lottery game. In the preferred embodiment, a standard electronic gaming device such as a slot machine or video slot machine would be used as the base unit for the implementation of the present invention, and examples of the events which might trigger the dispensing of a lottery ticket would include the hitting of a specific reel combination, a preset amount of coin in, a certain level of game play, or any other detectable electronic device event or series of events.

Figure 1:
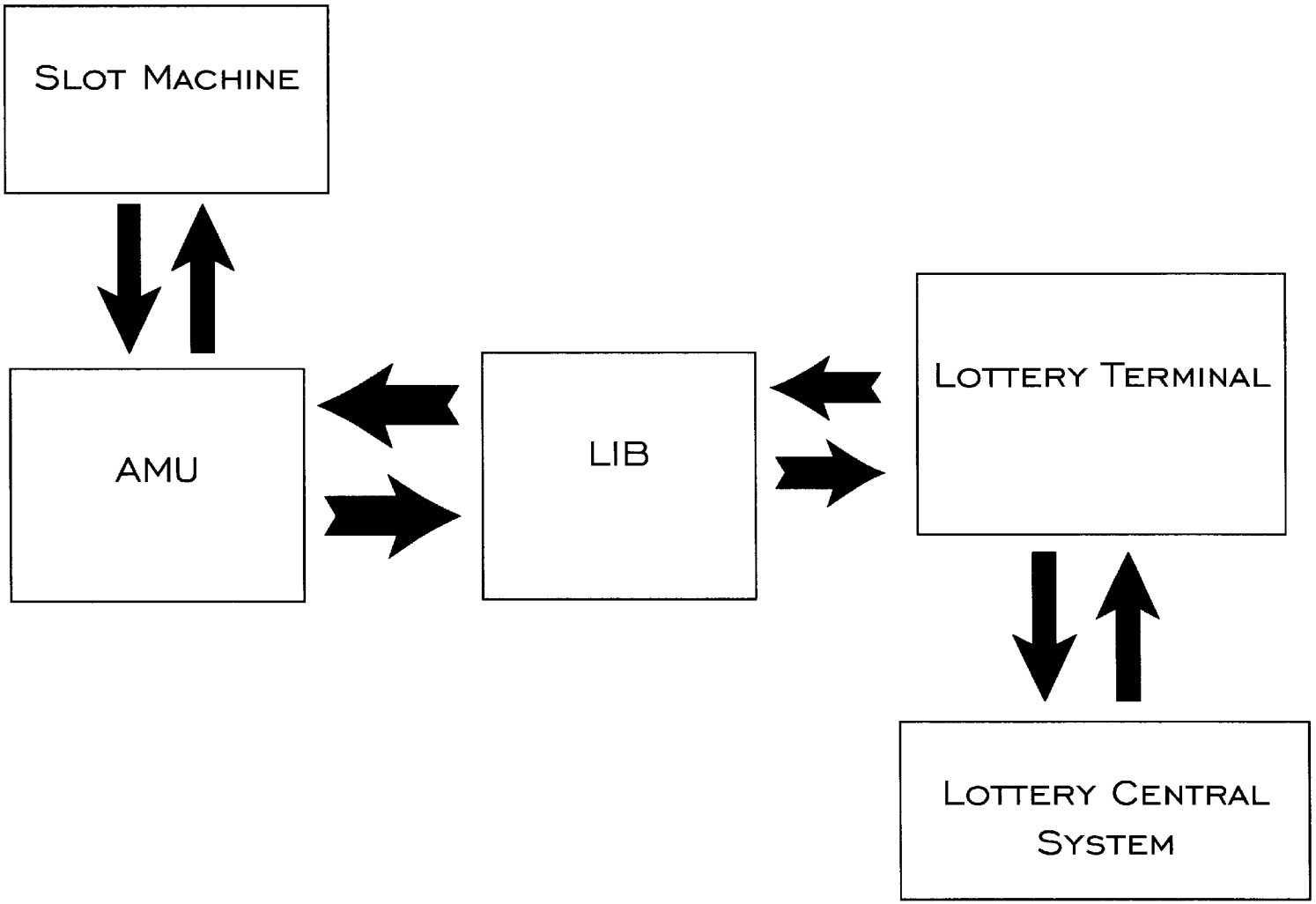
FIG. 1 is a block diagram showing the operation of the present invention.
Figure 2:
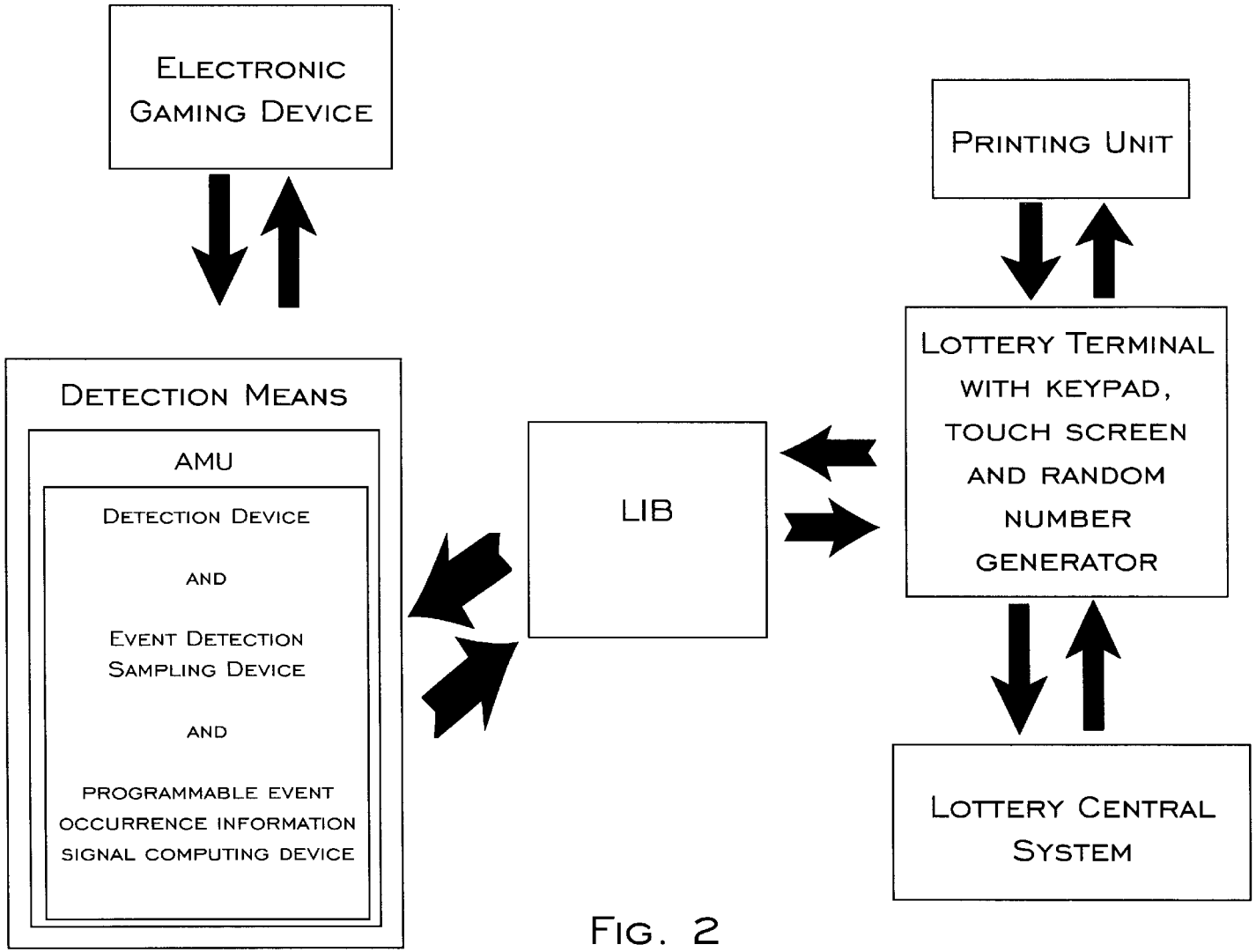
FIG. 2 is a lower-level block diagram of the operation of the present invention.

The preferred information flow of the present invention is shown in FIGS. 1 and 2 with the invention including an activity monitoring unit or AMU which would be connected to the electronic gaming device for monitoring event occurrences in the electronic gaming device, preferably to specific electronic gaming device elements including but not limited to a digital display board, a reel position sensor and a hard meter harness. In the preferred embodiment, the AMU would be a programmable electronic activity detector and command generator which would include at least one detection device adapted to be connected to the electronic gaming device board, an event detection sampling device in information transmission connection with the detection device and a programmable event occurrence information signal computing device connected to the event detection sampling device operative to output command signals therefrom for commanding a connected lottery ticket generating device to output a lottery ticket in response to a specific occurrence or occurrences in the electronic gaming device. Of course, it is to be understood that it is the functional characteristics of the AMU which are critical to the present invention, i.e. the monitoring and signaling functions of the AMU, not the specific embodiment of the AMU. Therefore, any appropriate monitoring and signaling device, method, software, firmware or system could be substituted in the present invention, or such could be incorporated directly into the gaming device, such as being built into the electronic gaming device board, programmed into the software of the electronic gaming device itself or incorporated into the lottery terminal software or hardware. In the present invention, the AMU would be programmed to output command signals which can be interpreted by a connected lottery interface board or LIB which receives the command signals from the AMU and converts those signals into commands which are readable by a lottery terminal for outputting of lottery tickets therefrom.

In the preferred embodiment, the LIB would preferably be a circuit board including a programmable microchip which would be programmed to accept the command signals from the AMU and output ticket generation commands to the lottery ticket terminal. Of course, it should be noted that the LIB is representative of any equivalent system for providing the interface between the electronic gaming device and the lottery terminal. Therefore, any appropriate lottery interface system could be substituted in the present invention, or such a system could be incorporated directly into the gaming device, such as being built into the electronic gaming device board or programmed into the software of the electronic gaming device itself. Preferably, however, to ensure that no or only minimal additional inspection and certification by the appropriate regulatory body of the various jurisdictions or their agents is required, the LIB would be a separately identifiable section, unit or system so that the inspector would be able to quickly and easily discern that the present invention does not influence and is incapable of affecting the outcomes of the electronic gaming device or the lottery. Therefore, the LIB will preferably be connected to the AMU by a serial interface and the AMU will be connected to the electronic gaming device by a hardwire harness to connect to the appropriate sampling location or locations on the electronic gaming device board or where appropriate. Regarding the appropriate connections to properly connect the LIB to the lottery terminal, it is expected that such connections would be understood by one skilled in the art of gaming device connections, depending upon the type of lottery terminal being used and the connection requirements. It should be noted that the electrical connections of the LIB to the lottery terminal would be understood by one skilled in the art and is not critical to the present invention whereas the functionality of the LIB is critical to the present invention.

Returning to the lottery terminal, in the case of Powerball®, for example, the lottery ticket terminal would be a MUSL (Multistate Lottery) proprietary terminal which is connected to the MUSL central system account in the common manner used in connection with lottery terminals. The lottery terminal would then print a lottery ticket through a printing unit which, in the preferred embodiment, would be attached externally to or be housed within the electronic gaming device on which the preset event or series of events had just occurred. In this manner, the player of the electronic gaming device may easily obtain a lottery ticket and/or voucher without leaving the vicinity of the electronic gaming device and without purchasing it separately. Of course, numerous variations of this setup are possible, as are the outputs of the lottery terminal depending on the associated lottery game. It is expected that one type of lottery game would be preselected for participation, but that one game may require additional inputs through an associated keypad or touch screen, to enable a player to choose his or her own numbers for participation in the lottery. Other variations might include a randomly generated entry (Quick Pick) or the chosen numbers could correspond to numbers generated by the electronic gaming device as part of a coordinated gaming scheme designed for use with this invention.

The AMU is programmed to recognize the occurrence of a specific event or series of events, and when that specific event or series of events occur(s), the AMU recognizes that occurrence and forwards an event notification signal to the LIB. The LIB then receives those signals and analyzes and translates those signals to signal the lottery ticket terminal to output a lottery entry ticket, if so commanded by the AMU. If so, the LIB outputs a lottery ticket generation command to the lottery ticket terminal. The terminal in turn commands the ticket to be printed at the printer location corresponding to the electronic gaming device at which the event or series of events occurred, thus allowing game play to continue uninterrupted and therefore not affecting the speed of game play. The system will function with the AMU being programmed to determine which events will cause the generation of lottery tickets, but it is the LIB which is vital to enable the signaling of the lottery ticket terminal to output at least one entry ticket.

At the present time, most, if not all, of the state-run lottery computers have built-in "down-time" during which time the maintenance on the system may be performed or implementation of new and/or modified software may be done. Also, unforeseen down-time can occur in the lottery system due to occurrence of system errors. In any event, during any down-time, lottery tickets cannot be printed by remote terminals. However, as most casinos operate on a 24-hour basis, it is virtually guaranteed that at least one event or series of events will occur on a electronic gaming device which induces the printing of a lottery ticket during the down-time of the lottery system. In this situation, the lottery terminal, lottery printer or alternative printer would be commanded to print a voucher ticket which the player of the electronic gaming device could later redeem for a lottery ticket at a time when the system is once again up and running. Of course, any acceptable type of printed or outputted indicia signifying entry into a lottery event can be substituted for the "tickets" or "vouchers" previously described, each of which would be understood by one skilled in the art of lottery gaming.

Of course, it is to be understood that numerous modifications, substitutions and additions may be made to the present invention which are within the intended broad scope of this disclosure. For example, many different types of lottery systems from many different manufacturers may be connected to the invention. Those different lottery systems may have different programming installed in the microchips of any of the command generator units and the particular hardwiring used to connect the device to the lottery terminal may also be different. Also, although the present invention has been described as being used in connection with a electronic gaming device, it should be noted that the AMU and LIB of the present invention are programmable for operation with virtually any type of electronic device, including video slot machines, video lottery terminals, video poker games, video keno games, vending machines and virtually any other electronic device which can be connected to the AMU and LIB. Furthermore, the present invention may be retrofitted onto existing electronic gaming devices due to the design of the AMU, and therefore can be used in almost any gaming situation. Finally, although the present invention has been described as commanding the dispensing of lottery tickets and/or vouchers, it should be noted that numerous other types of lottery-related products may be dispensed in response to event occurrences on the electronic device, such as pickle cards, scratch tickets, keno tickets, gaming tokens, raffle entries and other such items.

There has therefore been shown and described a lottery game/gaming device interface which accomplishes at least all of its intended objectives.

I claim:

1. A lottery terminal/electronic gaming device interface comprising:

at least one detection means adapted for connection to an electronic gaming device, said detection means operative to detect selected event occurrences on said electronic gaming device and output event occurrence notification signals upon detection of an event or series of events;

interface means in information transmission connection with said detection means, said interface means operative to detect and receive event occurrence notification signals from said detection means, analyze and translate said event occurrence notification signals and output lottery terminal operation commands; and lottery ticket terminal means in information transmission connection with said interface means and in information transmission connection with a central lottery system, said lottery ticket terminal means operative to receive said lottery terminal operation commands output by said interface means and output at least one entry ticket into a preselected lottery event via and in connection with said central lottery system whereby an operator of the electronic gaming device receives at least one entry into the preselected lottery event.

2. The lottery terminal/electronic gaming device interface of claim 1 wherein said detection means further comprises software programming in said electronic gaming device operative to detect selected event occurrences on an electronic apparatus and output event occurrence notification signals upon detection of an event.

3. The lottery terminal/electronic gaming device interface of claim 1 wherein said detection means comprises an activity monitoring unit connected to said electronic gaming device for monitoring selected event occurrences in said electronic gaming device, the activity monitoring unit comprising:

a programmable electronic activity detector and command generator, said programmable electronic activity detector and command generator including at least one detection device adapted to be connected to said electronic gaming device in information transmission connection therewith;

an event detection sampling device in information transmission connection with the detection device; and a programmable event occurrence information signal computing device connected to the event detection sampling device operative to output command signals therefrom for commanding said interface means to generate lottery terminal operation commands to said lottery ticket terminal means to output a lottery ticket in response to a specific occurrence or occurrences in said electronic gaming device.

4. The lottery terminal/electronic gaming device interface of claim 1 wherein said interface means comprises a lottery interface board including a circuit board having at least one programmable microchip programmed to receive, analyze and translate said event occurrence notification signals from said detection means and output lottery terminal operation commands to said lottery ticket terminal means.

5. The lottery terminal/electronic gaming device interface of claim 1 wherein said interface means comprises software programming programmed to receive, analyze and translate said event occurrence notification signals from said detection means and output lottery terminal operation commands to said lottery ticket terminal means.

6. The lottery terminal/electronic gaming device interface of claim 1 wherein said lottery ticket terminal means further comprises at least one of a keypad and a touch screen operative to permit entry of numerical values and a printing unit operative to output lottery tickets in response to lottery terminal operation commands received from said interface means via said lottery ticket terminal means.

7. The lottery terminal/electronic gaming device interface of claim 1 wherein said detection means, said interface means and said lottery ticket terminal means are cooperatively operative to transfer electronic gaming device-generated numerical information from said electronic gaming device to said lottery ticket terminal means, said numerical information identifying selected numerical values used for outputting at least one lottery ticket including said selected numerical values in response to lottery terminal operation commands received from said interface means into said lottery ticket terminal means.

8. The lottery terminal/electronic gaming device interface of claim 1 wherein said lottery ticket terminal means further comprises a generally random numerical value generating device operative to generally randomly select numerical values for inclusion on at least one lottery ticket including said generally randomly selected numerical values in response to lottery terminal operation commands received from said interface means into said lottery ticket terminal means.

9. A lottery terminal/electronic gaming device interface comprising:

at least one selected event occurrence detection and event occurrence notification signal output means adapted for connection to an electronic gaming device producing event occurrences;

event occurrence detection and event occurrence notification signal output and lottery terminal interface means in information transmission connection with said selected event occurrence detection and event occurrence notification signal output means, said event occurrence detection and event occurrence notification signal output and lottery terminal interface means operative to detect and receive event occurrence notification signals from said selected event occurrence detection and event occurrence notification signal output means and analyze and translate said event occurrence notification signals and output lottery terminal operation commands; and lottery ticket output terminal means in information transmission connection with said event occurrence detection and event occurrence notification signal output and lottery terminal interface means and in information transmission connection with a central lottery system, said lottery ticket output terminal means operative to output at least one entry ticket into a preselected lottery event whereby an operator of the electronic gaming device receives at least one entry via and in connection with said central lottery system into the preselected lottery event.

* * * * *

UNITED STATES PATENT AND TRADEMARK OFFICE

CERTIFICATE OF CORRECTION

PATENT NO. : 6,585,589 B2
DATED : July 1, 2003
INVENTOR(S) : Okuniewicz

It is certified that error appears in the above-identified patent and that said Letters Patent is hereby corrected as shown below:

Title page,
Item [60], Related U.S. Application Data, should read:

-- Provisional application No. 60/196,827, filed on Apr. 13, 2000 -- and also Continuation-in-part of application No. 08/944,075 filed on Dec. 19, 1997 now Patent No. 6,146,276, which is a Continuation-in-part of application No. 08/795,152 filed Feb. 7, 1997, now Patent No. 5,908,354 --.

Column 1,
Line 8, should read:
-- Apr. 13, 2000 -- and also Continuation-in-part of application No. 08/944,075 filed on Dec. 19, 1997 now Patent No. 6,146,276, which is a Continuation-in-part of application No. 08/795,152 filed Feb. 7, 1997, now Patent No. 5,908,354 --.

Signed and Sealed this

Twenty-first Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,585,589 B2
DATED : July 1, 2003
INVENTOR(S) : Okuniewicz

It is certified that error appears in the above-identified patent and that said Letters Patent is hereby corrected as shown below:

Title page,
Item [60], Related U.S. Application Data, should read:

-- Provisional application No. 60/196,827, filed on Apr. 13, 2000 and also -- Continuation-in-part of application No. 09/639,441 filed on Aug. 15, 2000 which is a -- Continuation-in-part of application No. 08/944,075 filed on Dec. 19, 1997 now Patent No. 6,146,276, which is a Continuation-in-part of application No. 08/795,152 filed Feb. 7, 1997, now Patent No. 5,908,354 --.

Column 1,
Line 8, should read:
-- Apr. 13, 2000 and also -- Continuation-in-part of application No. 09/639,441 filed on Aug. 15, 2000 which is a -- Continuation-in-part of application No. 08/944,075 filed on Dec. 19, 1997 now Patent No. 6,146,276, which is a Continuation-in-part of application No. 08/795,152 filed Feb. 7, 1997, now Patent No. 5,908,354 --.

This certificate supersedes Certificate of Correction issued September 21, 2004.

Signed and Sealed this

Twenty-second Day of February, 2005

JON W. DUDAS
*Director of the United States Patent and Trademark Office*